US006276142B1

(12) United States Patent
Pütz

(10) Patent No.: US 6,276,142 B1
(45) Date of Patent: Aug. 21, 2001

(54) COOLED HEAT SHIELD FOR GAS TURBINE COMBUSTOR

(75) Inventor: Heinrich Pütz, Much (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/507,355

(22) Filed: Feb. 18, 2000

Related U.S. Application Data

(63) Continuation of application No. PCT/DE98/02273, filed on Aug. 7, 1998.

(30) Foreign Application Priority Data

Aug. 18, 1997 (DE) ..... 297 14 742 U

(51) Int. Cl.[7] ..... F23R 3/00
(52) U.S. Cl. ..... 60/752
(58) Field of Search ..... 60/722, 752; 415/115, 415/116, 175

(56) References Cited

U.S. PATENT DOCUMENTS 4,422,300 12/1983 Dierberger et al. .
4,838,031 6/1989 Cramer .
5,167,487 * 12/1992 Rock ..... 415/175
5,273,396 * 12/1993 Albrecht et al. ..... 415/115
5,363,643 11/1994 Halila .

FOREIGN PATENT DOCUMENTS

0224817B1 7/1989 (EP) .
849255 9/1960 (GB) .
2166120A 4/1986 (GB) .

OTHER PUBLICATIONS

Published International Application No. 98/13645 (Gross et al.), dated Apr. 2, 1998.

* cited by examiner

*Primary Examiner*—Louis J. Casaregola
(74) *Attorney, Agent, or Firm*—Herbert L. Lerner; Laurence A. Greenberg; Werner H. Stemer

(57) ABSTRACT

A heat-shield component with cooling-fluid return includes an outer hollow body and an insert that can both be mounted on a supporting structure. The outer hollow body encloses the insert with a gap. The outer hollow body has a first bottom side which can be exposed to a hot gas. The insert has a second bottom side with a plurality of holes through which the cooling fluid flows into the gap for impact-cooling the first bottom side. A heat-shield configuration for a hot-gas conducting component as well as a heat-shield assembly are also provided.

5 Claims, 3 Drawing Sheets

COOLED HEAT SHIELD FOR GAS TURBINE COMBUSTOR

CROSS-REFERENCE TO RELATED APPLICATION

This application is a continuation of copending International Application No. PCT/DE98/02273, filed Aug. 7, 1998, which designated the United States.

BACKGROUND OF THE INVENTION

Field of the Invention

The invention relates to a heat-shield component which is part of a hot-gas wall to be cooled. The invention furthermore relates to a heat-shield configuration which lines a hot-gas space, in particular a combustion chamber of a gas-turbine plant, and has a plurality of heat-shield components. The invention additionally relates to a heat-shield assembly.

Due to high temperatures which prevail in hot-gas passages or other hot-gas spaces, it is necessary for an inner wall of a hot-gas passage to be constructed in the best possible manner in terms of temperature-resistance. On one hand, high-temperature-resistant materials, such as, for example, ceramics, are suitable for that purpose. The disadvantage of ceramic materials lies both in their great brittleness and in their unfavorable heat and temperature conductivity. A suitable alternative to ceramic materials for heat shields is high-temperature-resistant metal alloys on an iron, chromium, nickel or cobalt basis. However, since the service temperature of high-temperature-resistant metal alloys is markedly below the maximum service temperature of ceramic materials, it is necessary to cool metallic heat shields in hot-gas passages.

One possibility is proposed, for example, in U.S. Pat. No. 4,838,031 to Cramer, dated Jun. 13, 1989. Cramer proposes a panel which is formed of four components and is to be mounted on the inside of a combustion-chamber casing. In that case, a first or top layer facing the hot-gas space is made of a refractory metal, but may also be formed by a ceramic material. That is followed underneath by a second layer of steel-wool-like metallic filaments. Those filaments rest on a relatively large number of column-like supports. Those column-like supports and cavities in between form a third layer. The column-like supports are attached to a fourth metallic layer. The steel-wool-like metallic filaments of the second layer absorb heat energy from the overlying layer forming the inner burner wall and transfer that heat energy to an air flow directed between the column-like supports. In that case, the cavities of the third layer are connected, through passages which lead through the fourth layer and the burner casing, to a space outside the burner, and that space is fed with air through a compressor. The compressed air can pass as a coolant through those passages into the cavity formed by the layers.

In addition, a second type of passage is distributed over a front and center region of the combustion chamber. The air originating from the exterior of the combustion chamber passes through such passages through the combustion-chamber casing and the layered panels into the combustion chamber.

The proposal by Cramer has the disadvantage of causing cool air to flow into the combustion chamber over the entire region of the latter without having participated in the combustion. As a consequence thereof, the temperature at an outlet of the combustion chamber drops.

A heat-shield configuration, in particular for structural parts of gas-turbine plants, is described in European Patent 0 224 817 B1. The heat-shield configuration has an inner lining which is made of heat-resistant material and is composed of heat-shield elements in such a way as to cover the surface. The heat-shield elements are anchored to the supporting structure. Those heat-shield elements are disposed next to one another while leaving gaps for the throughflow of cooling fluid and they are thermally movable. Each of those heat-shield elements has a cap part and a shank part shaped like a mushroom. The cap part is a flat or spatial, polygonal plate body having straight or curved boundary lines. The shank part connects a central region of the plate body to the supporting structure. The cap part preferably has a triangular shape, as a result of which an inner lining of virtually any geometry can be produced by identical cap parts. The cap parts as well as other parts of the heat-shield elements, if need be, are made of a high-temperature-resistant material, in particular a steel. The supporting structure has bores through which a cooling fluid, in particular air, can flow into an intermediate space between the cap part and the supporting structure and can flow from there through the gaps, which are intended for the throughflow of the cooling fluid, into a spatial region, for example a combustion chamber of a gas-turbine plant, surrounded by the heat-shield elements. That cooling fluid flow reduces the ingress of hot gas into the intermediate space.

A wall, in particular for gas-turbine plants, which has cooling-fluid passages, is described in German Published, Non-Prosecuted Patent Application DE 35 42 532 A1. In gas-turbine plants, the wall is preferably disposed between a hot space and a cooling-fluid space. The wall is assembled from individual wall elements and each of the wall elements is a plate body made of a high-temperature-resistant material. Each plate body has parallel cooling passages which are distributed over its surface area and communicate at one end with the cooling-fluid space and at the other end with the hot space. The cooling fluid, flowing into the hot space and directed through the cooling-fluid passages, forms a cooling-fluid film on that surface of the wall element and/or adjacent wall elements which faces the hot space.

In summary, all of those heat-shield configurations, in particular for gas-turbine combustion chambers, are based on the principle that compressor air is utilized as a cooling medium for the combustion chamber and its lining as well as for sealing air.

The cooling and sealing air enters the combustion chamber without having participated in the combustion. That cold air mixes with the hot gas. As a result, the temperature at the outlet of the combustion chamber drops. Therefore, the output of the gas turbine and the efficiency of the thermodynamic process decrease. Partial compensation may be carried out by a higher flame temperature being set. However, that then results in material problems, and higher emission values have to be tolerated. It is likewise a disadvantage with the configurations specified that, in the case of the air fed to the burner, pressure losses result due to the entry of the cooling fluid into the combustion chamber.

International Publication No. WO 98/13645 A1, which was published subsequently to the priority date of the instant application, describes a heat-shield component with cooling-fluid return, having a hot-gas wall to be cooled, an inlet passage for cooling fluid, and an outlet passage for the cooling fluid. The inlet passage is directed towards the hot-gas wall and widens in the direction of the hot-gas wall. The inlet passage is largely surrounded by the outlet passage. The supporting structure is constructed as a twin-wall structure, having an outer wall and an inner wall disposed parallel to and adjacent the outer wall while leaving an intermediate space. In order to permit fastening to the supporting structure, the heat-shield component, at the outlet passage, has a fastening part with which the outlet passage is put onto the outer wall and fastened to the latter. Inside the outlet passage, the outer wall has an opening through which the inlet passage is directed while leaving a gap. The inner wall has a further opening into which the inlet passage is pushed over a short length. Cooling fluid can be fed to the heat-shield component through the inlet passage and discharged through the outlet passage. The inlet passage is covered with a cover wall which has impingement-cooling openings. Cooling fluid fed from the inlet passage can pass through the impingement-cooling opening and strike the hot-gas wall, in the course of which the latter is cooled.

SUMMARY OF THE INVENTION

It is accordingly an object of the invention to provide a heat-shield component which can be cooled with a cooling fluid, a heat-shield configuration having heat-shield components and permitting economical operation of a plant, for a hot-gas space of the plant, and a heat-shield assembly, which overcome the hereinafore-mentioned disadvantages of the heretofore-known devices of this general type.

With the foregoing and other objects in view there is provided, in accordance with the invention, a heat-shield component, which can be attached to a supporting structure, comprising an outer hollow body to be attached to a supporting structure, the outer hollow body having side walls and a first base side to be exposed to a hot gas; and an insert to be attached to the supporting structure, the insert enclosed by the outer hollow body and defining an intermediate space between the outer hollow body and the insert, the insert having side walls and a second base side with a plurality of openings for passage of cooling fluid into the intermediate space.

The heat-shield component can be attached to the supporting structure without the supporting structure having to be penetrated by the heat-shield component. As a result, the supporting structure can be configured largely with a closed surface, in which case relatively small openings, such as bores or the like, may be provided if need be, for example for fastening the heat-shield component in the supporting structure. Such bores can be made in a mechanically simple manner.

In accordance with another feature of the invention, the side walls of the insert are placed onto the supporting structure in such a way that an interior space, which is defined by the insert and the supporting structure, is formed. An interior space fluidically connected to the intermediate space through the openings is thereby formed. A cooling fluid can be directed into the interior space to begin with and this cooling fluid flows through the openings into the intermediate space and strikes the first base side in order to cool the latter.

In particular, the top edges of the side walls of the hollow body are disposed on the supporting structure along the full periphery of the heat-shield component and largely seal off the space, in which the cooling fluid is located, relative to the hot-gas space. The side walls of the hollow body preferably have a geometrical form which enables a seal to be introduced between the hollow body and the supporting structure. The seal may be constructed, for example, as a compression seal. In this case, due to the geometry of the hollow body, the seal lies on the cold side of the heat-shield component.

In accordance with a further feature of the invention, the insert is also exchangeable. The heat-shield component is thereby configured in such a way that, if need be, the insert or the outer hollow body in each case can be exchanged on its own.

In accordance with an added feature of the invention, a first outer hollow body and a second outer hollow body are attachable next to one another on the supporting structure, a side wall of the first outer hollow body and a side wall of the second outer hollow body are adjacent one another while leaving a gap, and the side walls in each case have a surface contour such that the gap is winding. As a result, the gap forms a choke point through which hot gas directed outside the heat-shield component can only penetrate into the gap with difficulty or cooling fluid issuing from the heat-shield component can only pass through the gap with difficulty. This can be achieved, for example, by interlocking steps or indentations of adjacent side walls of hollow bodies. As a result, cooling fluid or hot gas passing into the gap is deflected several times.

In accordance with an additional feature of the invention, the inner base side of the hollow body has cooling ribs or the like, as a result of which the cooling with a cooling fluid can be optimized.

In accordance with yet another feature of the invention, the heat-shield components are fastened to the supporting structure through a centrally attached retaining bolt. The retaining bolt may be provided with disc springs so that greater resilience is ensured if the heat-shield component exceeds the permissible expansion. For reasons of simple assembly, the retaining bolt can be attached to the hot side of the heat-shield component. However, it is also possible for the retaining bolt to be located on the cold side of the heat-shield component. The latter has an advantageous effect on the corrosion properties of the heat-shield component.

In accordance with yet a further feature of the invention, the base side of the hollow body alternatively has a triangular, four-cornered (in particular quadrilateral or trapezoidal) or hexagonal surface area. Other suitable geometrical forms are also possible. The typical order of magnitude is around 200 mm edge length for quadratic base sides of the hollow body. The wall thickness of the base side of the hollow body is preferably less than 10 mm, in particular preferably between 3 and 5 mm. A relatively small temperature difference between inner and outer surfaces of the base side of the hollow body is thereby ensured. A high alternating-load resistance of the heat-shield component can thus be achieved.

The heat-shield component is made of a heat-resistant material, in particular a metal or a metal alloy. It is advantageous to produce the heat-shield component, in particular the hollow body, as an investment or lost wax casting.

With the objects of the invention in view there is also provided a heat-shield configuration, comprising a plurality of heat-shield components disposed next to one another for attachment to a supporting structure, each of the heat-shield components having an outer hollow body to be attached to the supporting structure, the outer hollow body having side walls and a first base side to be exposed to a hot gas; an insert to be attached to the supporting structure, the insert enclosed by the outer hollow body and defining an intermediate space between the outer hollow body and the insert, the insert having side walls and a second base side with a plurality of openings for passage of cooling fluid into the intermediate space; and a wall of a hot gas directing component, in particular of a gas-turbine plant, the wall formed by the first and second base sides of the heat-shield component and the wall to be exposed to a hot gas.

A component directing hot gas, in particular a combustion chamber of a gas turbine, can be lined with such a heat-shield configuration. The heat-shield configuration protects the supporting structure, which may, for example, be a wall of the combustion chamber, against the heat effect caused by the hot gas. The individual heat-shield components can be cooled with a closed cooling-fluid circuit.

In accordance with another feature of the invention, the supporting structure for the heat-shield component has an inlet passage in each case for cooling fluid in a first region inside the side walls of the insert and an outlet passage from the intermediate space for cooling fluid. In this way, cooling fluid can be directed through the inlet passage into the insert of a heat-shield component, from which the cooling fluid passes through the openings into the intermediate space for impingement cooling of the respective first base side. The cooling fluid can be discharged from the intermediate space through the outlet passage.

In accordance with a further feature of the invention, the inlet passage is connected to a feed passage which is disposed outside the hot-gas space, and the outlet passage is connected to a discharge passage, which is likewise disposed outside the hot-gas space. Thus, cooling fluid can be fed to the inlet passage through the feed passage, and the cooling fluid heated after the impingement cooling can be discharged through the outlet passage and a discharge passage. In this way, cooling fluid can be directed in a closed cooling-fluid circuit.

In accordance with a concomitant feature of the invention, the cooling fluid is fed to the heat-shield component from a compressor, in particular of a gas turbine, through the feed passage, and is discharged through the discharge passage, and in the process is fed in particular to a burner. The cooling fluid can therefore be bled from a compressor in a simple manner and, after being heated by a cooling action, can be fed to a burner for the combustion. All of the compressor air can therefore be supplied to the combustion.

This ensures that the cooling fluid merely flows through the heat-shield component and is not able to penetrate into the hot-gas space. Due to this complete return of the cooling air from the heat-shield components, mixing of hot gas and cooling fluid accordingly does not occur, so that, if need be, a lower hot-gas temperature can be set in a gas-turbine plant. This is associated with a reduction in the nitrogen-oxide pollution. Due to the closed cooling-air return, there is likewise no flow around the edges of a heat-shield component, so that a largely uniform temperature distribution with low thermal stresses occurs in the material of the heat-shield component.

The supply of cooling air to the heat-shield component and the return of the heated cooling air to a burner of the gas-turbine plant are preferably effected through axially parallel supply passages. The passages can be widened as desired in the radial direction and their cross-sections can be adapted to the requisite cooling-air quantities. All of the heat-shield components therefore have essentially identical cooling-air inlet conditions. The flow path to the heat-shield components or of heated cooling air to the burner is only affected by relatively slight pressure losses due to its shortness.

Furthermore, pressure losses no longer occur due to the fact that no cooling fluid penetrates into the hot-gas space. The supply to the heat-shield components disposed on an outer side of a rotationally symmetrical component directing hot gas, in particular a combustion chamber of a gas-turbine plant, is preferably effected through the guide blades of a first guide-blade row of the gas turbine. If the quantity of cooling air which can be directed through the guide blades is insufficient for adequate cooling of the heat-shield components, it is possible to direct supply passages past the outer side of the component directing hot gas, in particular the combustion chamber.

The return of the heated cooling air is preferably effected through separate discharge passages which lead directly to a burner of a gas-turbine plant. It is likewise possible to lead the outlet passage of the heat-shield components directly into a main passage in which the compressor air is fed to the burner. In this way, the heat absorbed in the heat-shield components can be fed again to the gas-turbine process in an especially favorable manner.

Other features which are considered as characteristic for the invention are set forth in the appended claims.

Although the invention is illustrated and described herein as embodied in a heat-shield component with cooling-fluid return and a heat-shield configuration for a hot-gas conducting component and a heat-shield assembly, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
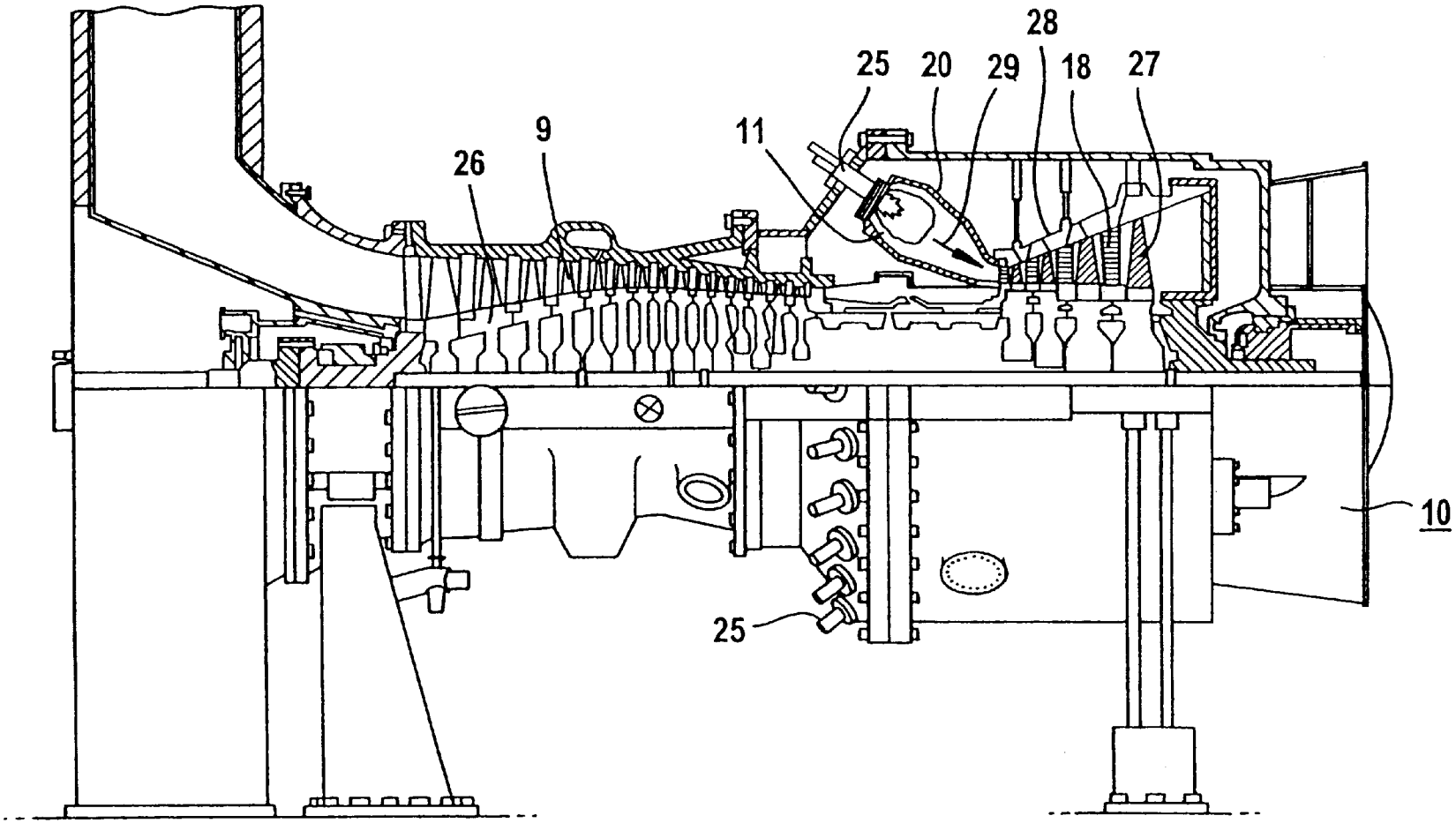
FIG. 1 is a fragmentary, diagrammatic, partly longitudinal-sectional view of a gas-turbine plant having an annular combustion chamber.

Referring now to the figures of the drawings in detail and first, particularly, to FIG. 1 thereof, there is seen a gas-turbine plant 10 which is shown partly cut open longitudinally. The gas-turbine plant 10 has a shaft 26 and, connected one behind the other in axial direction, a compressor 9, an annular combustion chamber 11 and blading (guide blades 18 and moving blades 27). Combustion air is compressed and heated in the compressor 9 and this combustion air is partly fed as cooling fluid 4 (indicated in FIG. 2) to a heat-shield configuration 20. The compressed air is fed to a plurality of burners 25 which are disposed in a circle around the annular combustion chamber 11. A non-illustrated fuel which is burned with the compressor air in the burners 25 forms a hot gas stream 29 in the combustion chamber 11. This hot gas 29 flows out of the combustion chamber 11 into the blading of the gas-turbine plant 10 (guide blade 18 and moving blade 27) and thus causes the shaft 26 to rotate.

In this case, provision is made for a combustion-chamber wall to be entirely lined with heat-shield components according to the invention which have the form of hollow tiles, or for the wall to be composed of such tiles which are held on a supporting structure outside the combustion space.

Figure 2:
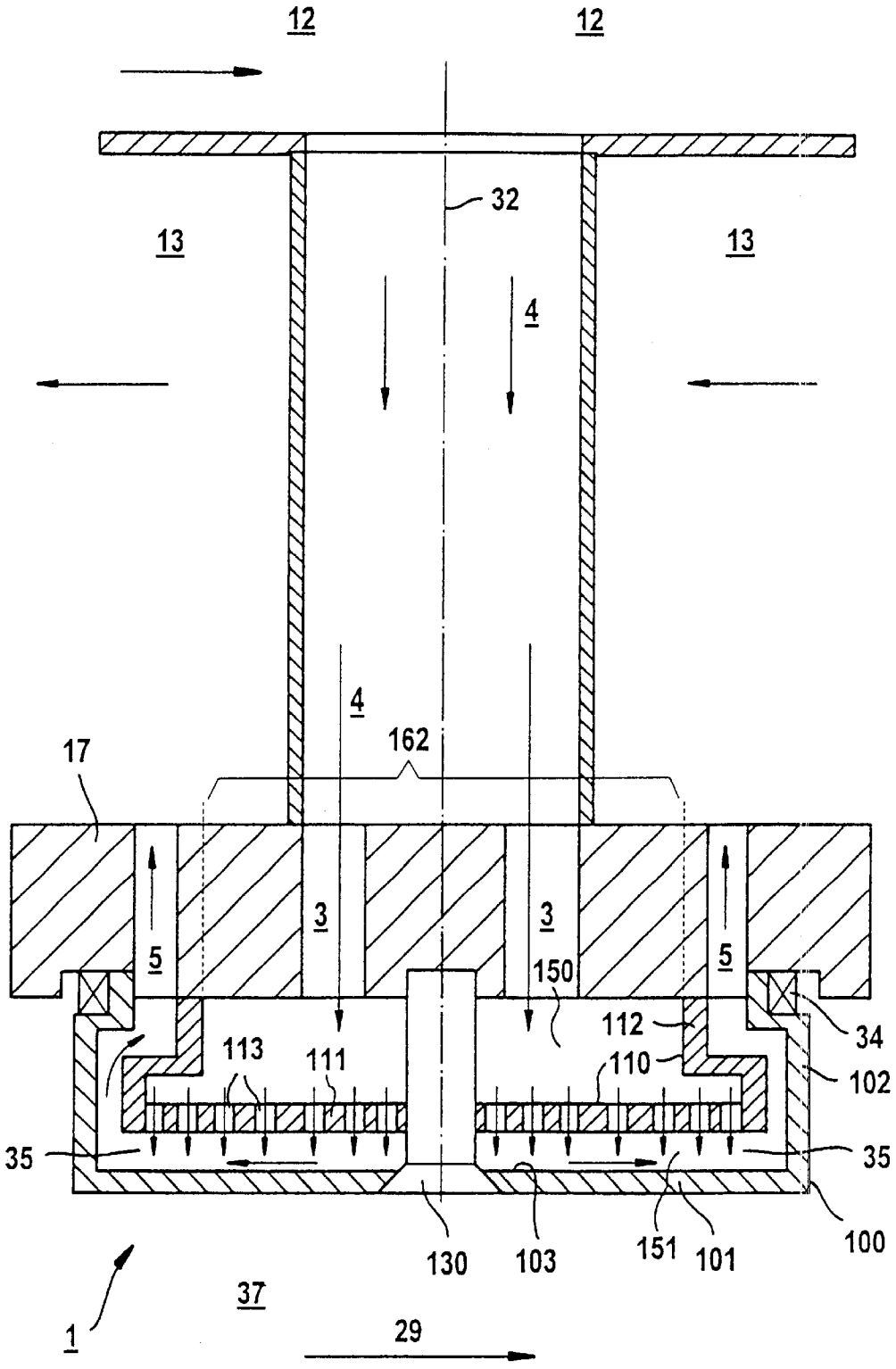
FIG. 2 is a longitudinal-sectional view of a heat-shield component having a supporting structure, a feed passage and a discharge passage.

A heat-shield component is diagrammatically illustrated in FIG. 2. The heat-shield component as a whole has been given reference numeral 1. The heat-shield component 1 has a hollow body 100 with a first base side 101 which can be exposed to a hot gas. This first base side 101 is exposed to the hot-gas stream 29. The hollow body 100 is laterally defined by side walls 102. These side walls 102 have a bottom edge disposed on a supporting structure 17. A further smaller hollow body is disposed as an insert 110 in the hollow body 100. This insert 110 has a second base side 111 with passage openings 113. The insert 110 is laterally defined by its side walls 112. The side walls 112 have an edge disposed on the supporting structure 17. An interior space 150, which is defined by the insert 110 and the supporting structure 17, is thereby formed. An intermediate space 151, which is defined by the insert 110, the hollow body 100 and the supporting structure 17, is also formed in this way. The supporting structure 17 has a region 162 which is located between the side walls 112 of the insert 110. The supporting structure 17 has one or more inlet passages 3 in the region 162, through which the cooling fluid 4 can pass into the interior space 150. Furthermore, the supporting structure 17 has outlet passages 5 leading from the intermediate space 151. In order to provide impingement cooling of the base side 101, the cooling fluid 4 flows through the inlet passages 3 into the interior space 150 of the insert 110 and passes through the passage openings 113 into the intermediate space 151, in the course of which it strikes an inner surface 103 of the base side 101. The cooling fluid which is heated after the impingement cooling is discharged from the intermediate space through the outlet passages 5, as is indicated by arrows in FIG. 2. The cooling fluid 4 is therefore directed in a closed circuit. This avoids a situation in which the cooling fluid 4 passes into a hot-gas space 37.

It is possible to prevent leakage flows between the supporting structure 17 and the side wall 102 of the hollow body 100 sitting on the supporting structure 17, through the attachment of seals 34. In this case, the seals 34 are constructed as compression seals. The side wall 102 of the hollow body 100 has a shoulder, through the use of which the seal 34 is pressed onto the supporting structure 17 in the region of a connecting point between the side wall 102 of the hollow body 100 and the supporting structure 17.

The cooling fluid 4 is supplied in such a way that the cooling fluid 4 is fed to the inlet passages 3 from the compressor 9 through a feed passage 12. In this case, this feed passage 12 lies outside the hot-gas space 37. The cooling fluid 4 is discharged through a discharge passage 13 likewise lying outside the hot-gas space 37. The cooling fluid 4 can be fed, for example, to the burner 25 through this discharge passage 13.

In the illustrated exemplary embodiment, the heat-shield component 1 is fixed to the supporting structure 17 by a retaining bolt 130. This retaining bolt 130 is disposed in the center of the illustrated rectangular structure. The retaining bolt 130 has an axis oriented along a main axis 32 of the heat-shield component. In the exemplary embodiment, the retaining bolt is made with a thickened portion on a hot side of the heat-shield component 1 and is mounted with an thinner end on the supporting structure 17. The retaining bolt may be provided with non-illustrated disc springs in order to compensate for a situation in which a permissible thermal expansion of the heat-shield component 1 is exceeded.

If the insert 110 and the hollow body 100 are connected in a mechanically detachable manner only through the use of the retaining bolt 130, the inserts can be exchanged for other inserts which produce another cooling-fluid flow zone in an intermediate space 35 between the hollow body 100 and the insert 110. Cooling conditions for the base side 101 of the hollow body 100 can thereby be adapted to specific requirements which result from the position of the heat-shield component 1 in the hot-gas passage.

Figure 3:
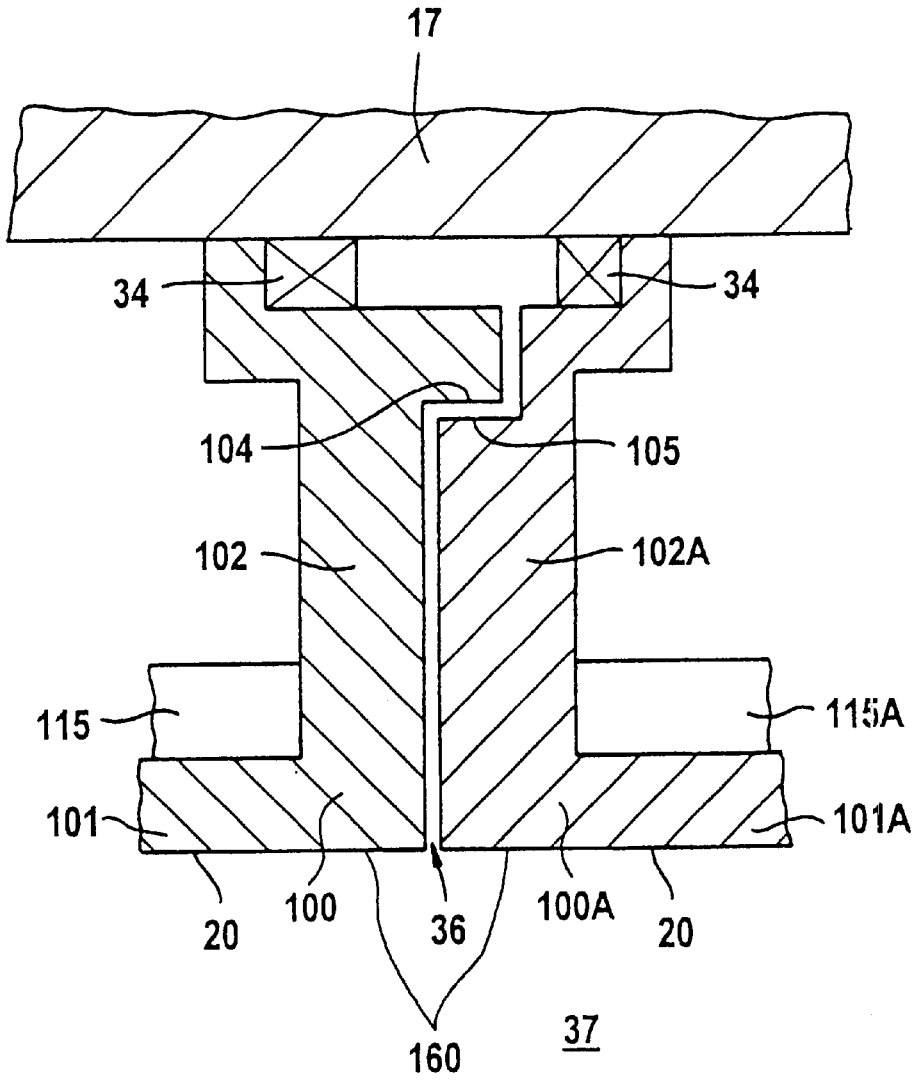
FIG. 3 is a sectional view of side walls of adjacent hollow bodies, which are put onto a supporting structure.

FIG. 3 shows an enlarged, fragmentary portion of a heat-shield configuration 20. The heat-shield configuration is formed from a plurality of heat-shield components disposed on the supporting structure 17. In FIG. 3, only two heat-shield components 100 and 100A are shown for the sake of clarity, in which case two side walls 102 and 102A of two adjacent hollow bodies 100 and 100A as well as a part of the supporting structure 17 can be seen. In this case, cooling ribs on first base sides 101 and 101A, which run radially relative to the side walls 102 and 102A, are indicated by reference symbols 115 and 115A. The base sides 101 and 101A of the heat-shield components 100 and 100A, along with base sides of heat-shield components which are not shown, form a wall 160 which can be exposed to a hot gas.

The adjacent side walls 102, 102A of the hollow bodies 100, 100A have a mutually corresponding surface contour. This surface contour is configured in such a way that the side wall 102A of the hollow body 100A shown on the right-hand side in the drawing has a shoulder 105, with which a mating shoulder 104 of the side wall 102 of the hollow body 100 shown on the left-hand side corresponds. Due to this shaping with the shoulder 105 and the mating shoulder 104, a gap 36 which is non-linear leads to the supporting structure 17 from the hot-gas space 37.

This ensures even better protection of the supporting structure 17 from heating by the hot gas in the hot-gas space 37. Since the hollow bodies 100, 100A can be manufactured by the investment-casting or lost-wax process, geometrical forms such as those described cause no manufacturing difficulties. It is, of course, also possible to select other geometrical forms for the side walls 102 and 102A of the hollow bodies 100 and 100A, in which a linear gap between the hot-gas space 37 and the supporting structure 17 is avoided.

I claim:

1. A gas turbine, comprising:

a combustion chamber with an inner wall acting as a supporting structure; and a heat-shield configuration including a plurality of heat-shield components disposed next to one another for attachment to said supporting structure, each of said heat-shield components having:

an outer hollow body to be attached to the supporting structure, said outer hollow body having side walls and a first base side to be exposed to a hot gas;

an insert to be attached to the supporting structure, said insert enclosed by said outer hollow body and defining an intermediate space between said outer hollow body and said insert, said insert having side walls and a second base side with a plurality of openings for passage of cooling fluid into said intermediate space; and a hot gas directing component wall to be exposed to a hot gas, said wall formed by said first and second base sides of said heat-shield component.

2. A gas turbine, comprising:

a combustion chamber having an inner wall acting as a supporting structure;

a heat-shield configuration including a plurality of heat-shield components disposed next to one another for attachment to said supporting structure, each of said heat-shield components having an outer hollow body to be attached to the supporting structure, said outer hollow body having side walls and a first base side to be exposed to a hot gas; an insert to be attached to the supporting structure, said insert enclosed by said outer hollow body and defining an intermediate space between said outer hollow body and said insert, said insert having side walls and a second base side with a plurality of openings for passage of cooling fluid into said intermediate space; and a hot gas directing component wall to be exposed to a hot gas, said wall formed by said first and second base sides of said heat-shield component;

said supporting structure having an inlet passage for cooling fluid in a region inside said side wall of said insert, and an outlet passage from said intermediate space for cooling fluid.

3. The heat-shield assembly according to claim 2, including a hot-gas space, a feed passage disposed outside said hot-gas space and connected to said inlet passage, and a discharge passage disposed outside said hot-gas space and connected to said outlet passage.

4. The heat-shield assembly according to claim 3, including a compressor feeding the cooling fluid through said feed passage to said heat-shield component.

5. The heat-shield assembly according to claim 4, including a burner receiving the cooling fluid from said discharge passage.

* * * * *

UNITED STATES PATENT AND TRADEMARK OFFICE

CERTIFICATE OF CORRECTION

PATENT NO. : 6,276,142 B1
APPLICATION NO. : 09/507355
DATED : August 21, 2001
INVENTOR(S) : Heinrich Pütz It is certified that error appears in the above-identified patent and that said Letters Patent is hereby corrected as shown below:

On title page
Item (54) should read as follows:

Heat-Shield Component with Cooling-Fluid Return, Heat-Shield Configuration for a Hot-Gas Conducting Component and Heat-Shield Assembly Signed and Sealed this Eighth Day of April, 2008

JON W. DUDAS
*Director of the United States Patent and Trademark Office*

UNITED STATES PATENT AND TRADEMARK OFFICE

CERTIFICATE OF CORRECTION

PATENT NO. : 6,276,142 B1
APPLICATION NO. : 09/507355
DATED : August 21, 2001
INVENTOR(S) : Heinrich Pütz It is certified that error appears in the above-identified patent and that said Letters Patent is hereby corrected as shown below:

On title page and column 1 lines 1 and 2
Item (54) should read as follows:

Heat-Shield Component with Cooling-Fluid Return, Heat-Shield Configuration for a Hot-Gas Conducting Component and Heat-Shield Assembly This certificate supersedes the Certificate of Correction issued April 8, 2008.

Signed and Sealed this

Sixth Day of May, 2008

JON W. DUDAS
*Director of the United States Patent and Trademark Office*